US006959525B2

(12) United States Patent
Prakken

(10) Patent No.: US 6,959,525 B2
(45) Date of Patent: Nov. 1, 2005

(54) METHOD AND ASSEMBLY FOR FILLING A BOX

(75) Inventor: Nicolaas Martin Prakken, Woerden (NL)

(73) Assignee: BluePrint Holding B.V., Woerden (NL)

( * ) Notice: Subject to any disclaimer, the term of this patent is extended or adjusted under 35 U.S.C. 154(b) by 0 days.

(21) Appl. No.: 10/751,435

(22) Filed: Jan. 6, 2004

(65) Prior Publication Data

US 2005/0144912 A1 Jul. 7, 2005

(51) Int. Cl.[7] ..... B65B 39/12
(52) U.S. Cl. ..... 53/447; 53/543; 53/249
(58) Field of Search ..... 53/447, 443, 150, 53/531, 540, 543, 384, 147, 249

(56) References Cited

U.S. PATENT DOCUMENTS

| | | | | |
|---|---|---|---|---|
| 3,370,549 A | | 2/1968 | Livingston | |
| 3,641,735 A | | 2/1972 | Daily et al. | |
| 3,748,797 A | | 7/1973 | Deines | |
| 4,660,352 A | | 4/1987 | Deines et al. | |
| 5,056,299 A | * | 10/1991 | Furukawa et al. | 53/571 |
| 5,123,231 A | | 6/1992 | Fallas et al. | |
| 5,284,003 A | * | 2/1994 | Goodman et al. | 53/437 |
| 5,657,610 A | * | 8/1997 | Dietrich et al. | 53/139.5 |
| 5,791,124 A | * | 8/1998 | Spatafora | 53/456 |
| 5,857,311 A | * | 1/1999 | Focke et al. | 53/434 |
| 6,061,996 A | | 5/2000 | Vissers et al. | |
| 6,430,895 B1 | * | 8/2002 | Kitagawa et al. | 53/247 |
| 6,574,943 B2 | * | 6/2003 | Van Dam | 53/447 |
| 2003/0033788 A1 | | 2/2003 | Van Dam Aaldert Christiaan | |

* cited by examiner

*Primary Examiner*—John Paradiso
(74) *Attorney, Agent, or Firm*—Young & Thompson

(57) ABSTRACT

Method and assembly for filling a box with relatively flexible bags, such as snack food bags of relatively small size. Two rows of bags are horizontally placed adjacent to each other. A number of groups or rows can be vertically placed above each other in a box. To that end first of all a cassette is filled by transferring bags having a fixed spacing and lowering them in a cassette. After the cassette is filled, it is closed at its upper side and in lateral direction emptied.

8 Claims, 3 Drawing Sheets

METHOD AND ASSEMBLY FOR FILLING A BOX

BACKGROUND OF THE INVENTION

1. Field of the Invention

The present invention relates to a method and apparatus for filling a box with a number of bags, more particular bags being relatively flexible.

2. Prior Art

It is generally known in the art to automatically fill boxes with a number of bags. To that end bags originating from a conveyor are placed in a cassette and after filling such cassette with a row or group of bags, such row or group is transferred into a box by a pusher. An example for such a method can be found in U.S. Pat. No. 6,574,943.

Although this device is suitable for packaging relative large bags in boxes, problems arise if a relatively large number of small bags being relatively flexible, because of their gaseous filling, have to be packaged in a box. Manual insertion is expensive and inefficient, whilst automatic insertion was not possible up to now with the required speed and 100% guarantee that the required number of bags is processed and placed in the related box.

SUMMARY OF THE INVENTION

According to subject invention a method is provided for filling a box with a number of flexible bags, comprising providing a first linear group of equally spaced bags on a first surface, engaging each of said bags of said group by suction with a transferral means, lifting said group of bags from said first surface, followed by horizontally displacing said group of bags from said first surface, after which said group of bags is lowered in a first position in a cassette, providing a second linear group on said first surface transferring said second linear group into said cassette by placing said second group horizontally adjacent to said first group, providing a third linear group on said first surface, transferring said third linear group and placing said group vertically on top of said first or second linear group in said cassette, filling said cassette by further groups of bags, horizontally displacing the plurality of bags, after filling said cassette, from said cassette into a box having its opening in lateral direction.

According to a further aspect the invention relates to an assembly comprising a first conveyor for supplying bags, a second conveyor adjacent to said first conveyor and having means to equally space a group of bags on a first surface thereof, cassette means for receiving groups of bags, said means being adjacent to said first surface, transferal means for transferring a group of bags from said first surface to said cassette means, said cassette means defining a parallelepiped shaped cavity for receiving said group of bags, having a closable insertion opening at its top, a stationary bottom, two opposed stationary side walls and two displaceable side walls, one of said displaceable side walls comprising a pusher plate for transferring said group into a box and the other of said displaceable walls being displaceable to allow passage of said group of bags from said cassette into a box.

The invention will be further elucidated referring to a preferred embodiment of the invention.

DETAILED DESCRIPTION OF A PREFERRED EMBODIMENT OF THE INVENTION

Figure 1:
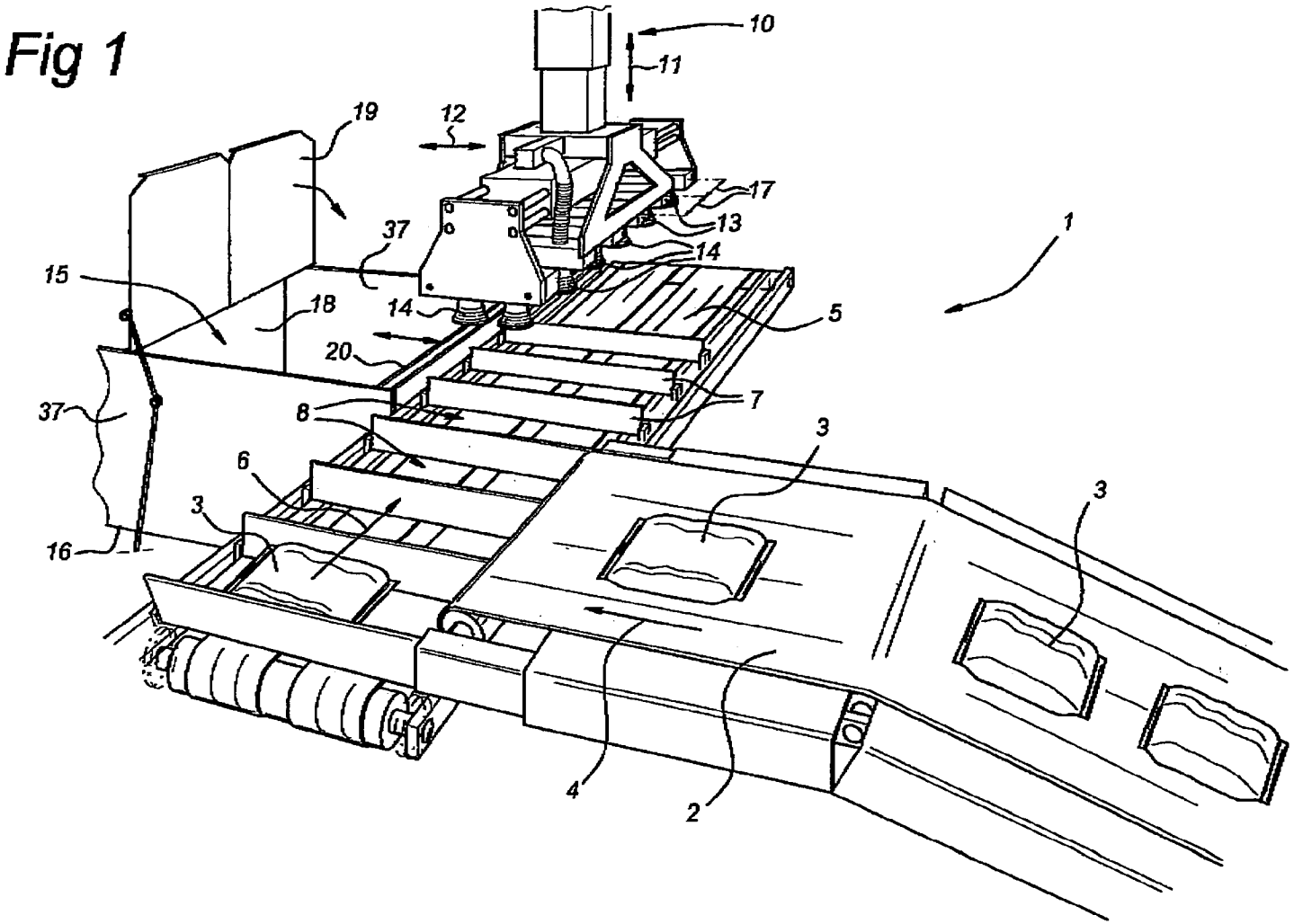
FIG. 1 shows a perspective view of the assembly according to the invention.

An assembly according to the invention is generally referred to by 1. It comprises a first conveyor belt 2 for supplying flexible bags 3. These bags are preferably relatively small bags, having a large gas content, such as crisp bags and other snack food bags. Conveyor 2 is moved in the direction of arrow 4 and substantially perpendicular to a second conveyor 5. Of course it should be understood that the relative position of conveyors 2 and 5 can be different, i.e. conveyor 5 can be in the extension of conveyor 2. This conveyor is moved in the direction of arrow 6 and comprises a number of separations 7, defining cavities 8. Each cavity is embodied to receive a single package 3. The assembly of separations 7 can be moved independently from the second conveyor 5. An example for such conveyor can be found in U.S. patent application Ser. No. 10/129,480. Generally at higher speeds preferably a conveyor should be used wherein on several locations independent movement of the bags can be realised. I.e. on a loading position the speed of movement of a compartment defined by separations 7 can be different from the speed at the discharge position.

A transferral arm 10 or pick and place unit is provided which can move in vertical direction according to arrow 11 and in horizontal direction according to arrow 12. The drive of arm 10 is not shown, but can comprise any electric hydraulic or pneumatic system known in the art. From arm 10 in this example five auxiliary arms 13 extend being provided with suction caps 14 at each lower end thereof. Suction caps 14 are connected in a way not shown and suction thereto can be controlled by a single valve or a number of valves.

Arm 10 can move between a position above second conveyor 5 and a cassette 15 in horizontal direction according to arrow 12. Vertical displacement is possible in the direction of arrow 11. Arrows 17 denote the possibility of sliding of the auxiliary arms 13 in horizontal direction relative to each other, such that the spacing between the suction caps 14 can be altered.

Cassette 15 comprises a stationary bottom wall 16, two opposed side walls 17 of which a single one is shown for clarity purposes, a tiltable side or end wall 18, a tiltable top wall 19 and a pusher wall 20, which can be pushed in the direction of arrow 21.

In FIG. 1 top wall 19 is shown in the open position. In this way it is possible to transfer items from belt 5 into cassette 15 by transferal arm 10. Downstream of the transferral arm 10 a box 25 is provided, being tilted so that its bottom is vertical (indicated by 26) and the closing flaps 27 thereof being substantially horizontal in the open position thereof. This box can be any paper board box known in the art, which can be either closed by tape or being a reusable box having a snap closing system.

The device described above functions as follows. From conveyor belt 2 moving in direction 4 flexible bags with relatively small dimension are supplied to belt 5 moving perpendicular in the direction of arrow 6. The supply of bags 3 can be irregular. Movement of the separations 7 on belt 5 is such that between each of the separations 7 only a single bag is positioned. The bags can either be positioned exactly between two separations 7, but it is also possible that such bags extend partially over a separation 7.

After or at the time a bag is put between two separations 7, the assembly of separations will move together with the belt 5 in the direction of arrow 6, providing a new cavity between two separations for receiving a further bag. As soon as five bags are placed between separations 7, the spacing between the bags is effected such that this corresponds to the spacing between suction caps 14. Subsequently, arm 10 is lowered from the position shown in FIG. 1 and after touching the flexible bags by caps 14, suction is provided, such that each of the flexible bags is engaged by suction. Movement in vertical direction in the direction of arrow 11 upwardly of arm 10 will result in lifting of the group of bags from conveyor belt 5.

Figure 2:
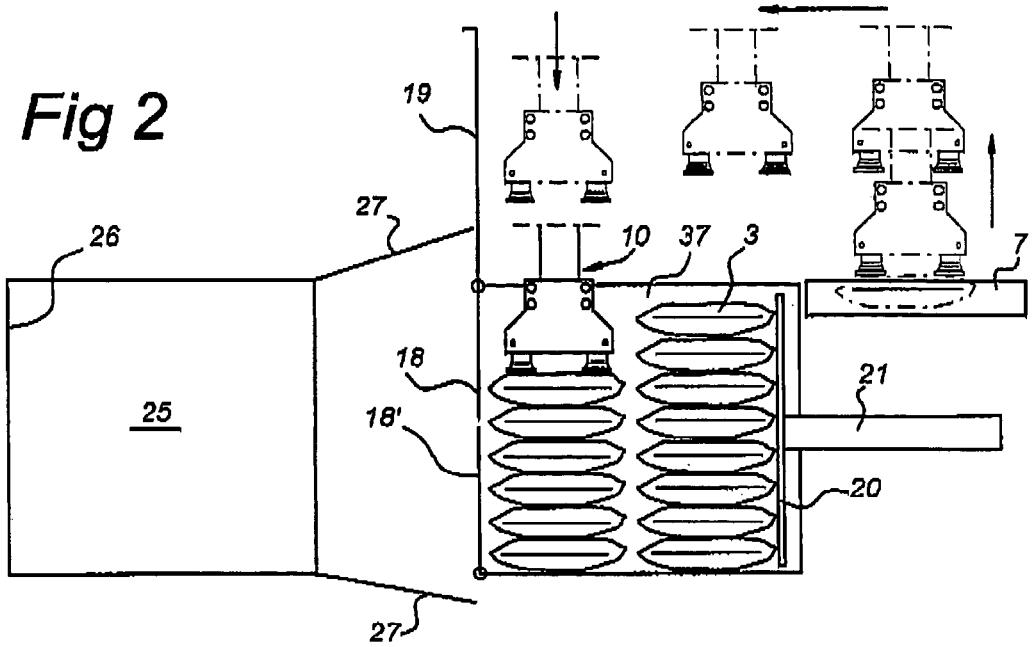
FIGS. 2–5 show in detail several stages of loading/unloading of the cassette.
Figure 3:
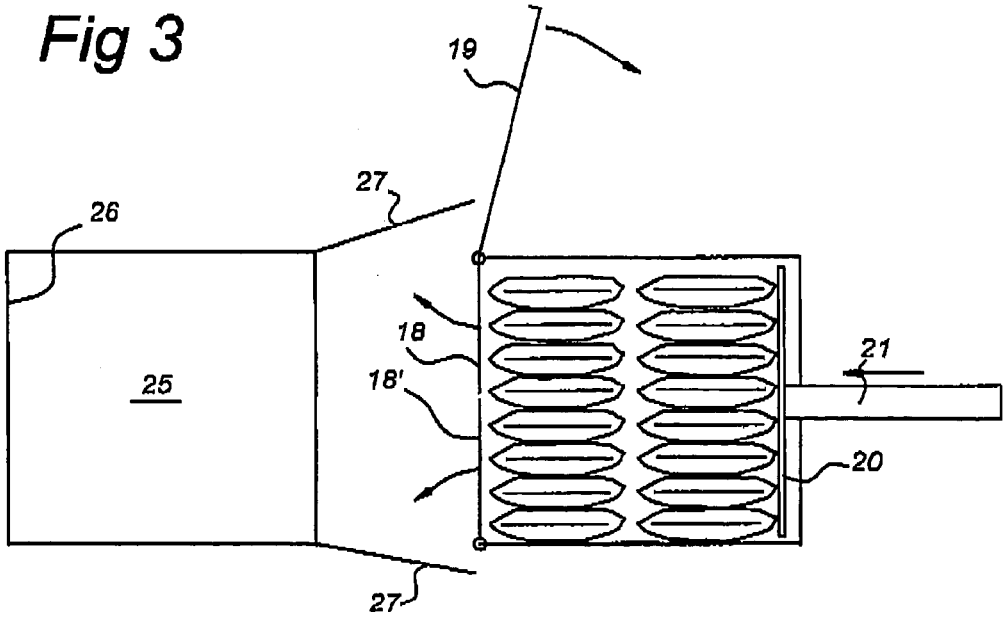

Engagement of the bags is in the position that the suction caps 14 are at a relative large spacing from each other. After lifting bags 3 tom the conveyor, arm 10 is moved to the left in the direction of arrow 12, to position arm 10 above cassette 15. Two positions of arm 10 above cassette 15 have to be distinguished. As is clear from FIG. 2 two rows of bags can be filled in the horizontal plane adjacent to each other in cassette 15. Depending from the required position, arm 10 will be displaced more or less from the starting position shown in FIG. 1. After that arm 10 will be lowered into the cassette 15. During this transferral the spacing between suction caps 14 will be decreased resulting in decreasing the distance between the first and last bag. In this relatively compressed position of the bags, a group of five bags will be stacked into the cassette. After insertion into the cassette 15, suction is removed, so that at lifting of the auxiliary arms 13, there will be no longer engagement between suction caps 14 and bags 13 resulting in disposition of the bags 13 into the cassette.

Figure 4:
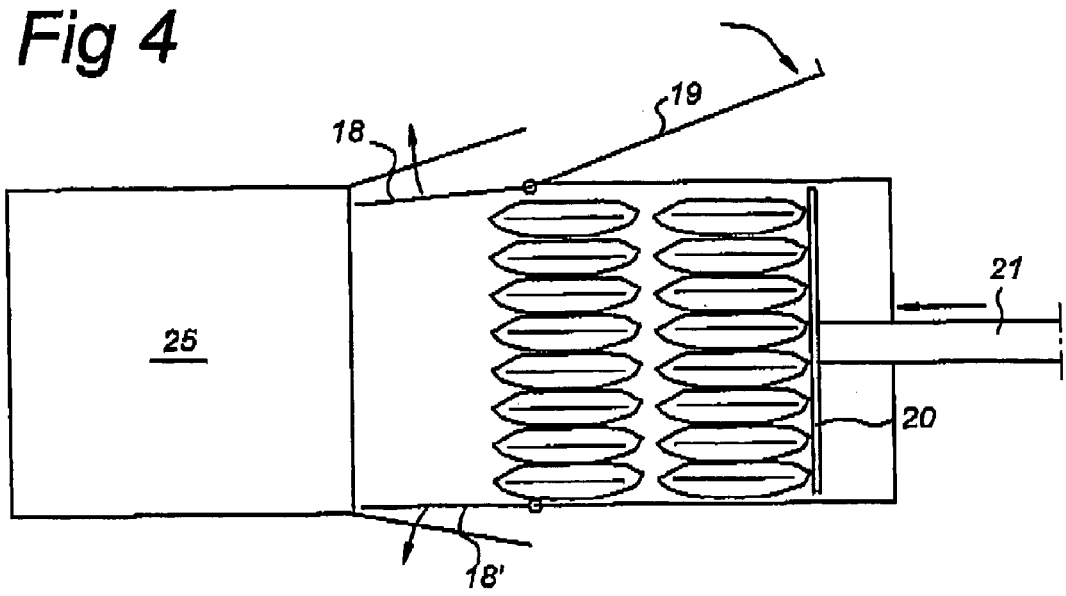
Figure 5:
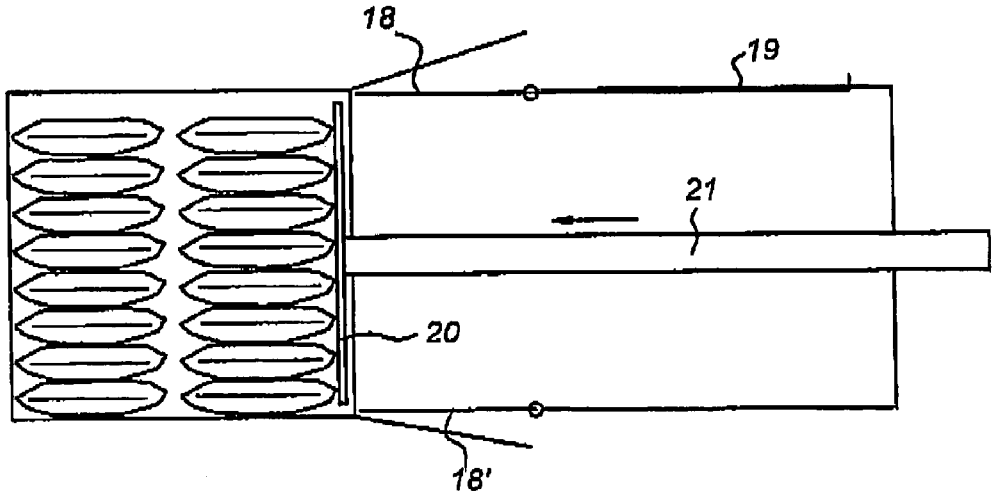

During a next step a further adjacent row or group of bags can be placed into the cassette. After that in vertical direction a further group of bags can be stacked. This action is repeated until the cassette has been filled with the required number of bags, which are positioned relatively tightly against each other. After lifting the arm 10, such that the caps 14 are outside the cassette 15, top wall 19 is lowered by pivoting as is shown in FIG. 4. Before, after or at the same time wall 18 is moved to a horizontal position as is also shown in FIG. 4. During the movement of top wall 19 some further compression of the bags in vertical direction can be realised. After that pusher 21 becomes active displacing wall 20 to the left, resulting in that the group of bags is pushed into the box 25 along flaps 27 against the bottom 26. After that wall 20 is returned to the starting position and walls 18 and 19 are returned to the vertical position after which box 25 can be removed and flaps 27 closed. If e.g. relative heavy articles have to be packaged compressing with top wall 19 is not necessary, so that this top wall could not be present.

With subject invention it is possible to fill a box in a very accurate way with a number of adjacent rows of relatively small bags. Also, several rows or group of bags can be positioned above each other at a high speed. Because a cavity or pocket is realised between the separations 7 having a fixed spacing accurate positioning for suction caps 14 is provided.

It will be understood that different kinds of patterns can be realised in a box. It is not only possible to put the bags accurately above each other, but also staggered arrangements can be realised.

According to a further embodiment of the invention different kinds of products can be packaged in one box.

The unique combination of a cassette which is loaded from above and the accurate spacing of the bags on conveyor 5, have resulted in a very reliable and quick operating transferral mechanism for the bags and it has been found that the error rate is very low or even neglectible.

Although the invention has been described above referring to a preferred embodiment of the invention, the person skilled in the art will immediately realise that further additions can be made without leaving the scope of the appended claim.

I claim:

1. A method for filling a box with a number of flexible bags, comprising providing a first linear group consisting of a single row of equally spaced bags on a first surface, engaging each of said bags of said group by suction with a transferral means, lifting said group of bags from said first surface, followed by horizontally displacing said group of bags from said first surface, after which said group of bags is lowered in a first position in a cassette, thereafter providing a second linear group in a single row on said first surface and transferring said second linear group into said cassette by placing said second group horizontally adjacent to said first group, thereby to form two horizontally side-by-side groups of bags, providing a third linear group on said first surface, transferring said third linear group and placing said group vertically on top of said first or second linear group in said cassette, filling said cassette by further groups of bags, horizontally displacing the plurality of bags, after filling said cassette, from said cassette into a box having its opening in lateral direction.

2. The method according to claim 1, wherein said groups comprise different bags.

3. The method according to claim 1, wherein during transferral from said first surface to said cassette the spacing of the bags in a group is changed.

4. The method according to claim 1, wherein providing said group of bags comprises supply of individual bags to a conveyor on which said first group is assembled.

5. An assembly comprising a first conveyor for supplying bags, a second conveyor adjacent to said first conveyor and having means to equally space a group of bags on a first surface thereof, cassette means for receiving groups of bags, said means being adjacent to said first surface, transferral means for transferring a group of bags from said first surface to said cassette means, said cassette means defining a parallelepiped shaped cavity for receiving said group of bags, having a closable insertion opening at its top, a stationary bottom, two opposed stationary side walls and two displaceable side walls, one of said displaceable side walls comprising a pusher plate for transferring said group into a box and the other of said displaceable walls being displaceable to allow passage of said group of bags from said cassette into a box.

6. The assembly according to claim 5, wherein said transferral means comprise vacuum engagement means.

7. The assembly according to claim 5, wherein said transferral means have engagement means for each of said bags, said engagement means being displaceable relative to each other.

8. The assembly according to claim 5, wherein said second conveyor is substantially perpendicular to said first conveyor.

* * * * *